US005123265A

United States Patent [19]

Ramot

[11] Patent Number: 5,123,265

[45] Date of Patent: Jun. 23, 1992

[54] INVISIBLE GEMSTONE SETTING

[76] Inventor: Boaz Ramot, 10 Ehad Ha'am Street, 33103 Haifa, Israel

[21] Appl. No.: 599,926

[22] Filed: Oct. 19, 1990

[30] Foreign Application Priority Data

Oct. 20, 1989 [IL] Israel ..... 92063

[51] Int. Cl.[5] ..... A44C 17/02

[52] U.S. Cl. ..... 63/28; 63/32

[58] Field of Search ..... 63/26, 27, 28, 30, 32; 29/10; D11/34, 39, 89, 90, 91

[56] References Cited

U.S. PATENT DOCUMENTS 4,738,240 4/1988 Aich ..... 63/26
4,813,246 3/1989 Richards ..... 63/26

FOREIGN PATENT DOCUMENTS 276183 7/1988 European Pat. Off. ..... 63/26
692948 11/1930 France ..... 63/28
826559 4/1938 France ..... 63/28
48920 9/1938 France ..... 63/28
833234 10/1938 France ..... 63/28
498471 1/1939 United Kingdom ..... 63/28

*Primary Examiner*—Renee S. Luebke
*Assistant Examiner*—Michael J. Milano
*Attorney, Agent, or Firm*—Benjamin J. Barish

[57] ABSTRACT

A gemstone assembly includes one or more gemstones and a setting having a base formed with a plurality of ribs defining one or more sockets of polygonal configuration for receiving the gemstones. Each gemstone is of a polygonal configuration corresponding to its socket, and is formed with an upper table, a lower pavilion, a girdle, and grooves extending through at least two opposed sides of the pavilion just below the girdle, the ribs of the setting being bent at their outer ends into the grooves to fix the gemstones in their sockets.

10 Claims, 2 Drawing Sheets

INVISIBLE GEMSTONE SETTING

FIELD AND BACKGROUND OF THE INVENTION

The present invention relates to a gemstone assembly comprising at least one gemstone, preferably a plurality of gemstones, and a setting therefor, wherein the setting is substantially invisible. The invention is particularly applicable to assemblies of a plurality of diamonds, and is therefore described below with respect to this application, but it will be appreciated that the invention could advantageously be used for assemblies of one or more other types of gemstones.

Assemblies including a plurality of gemstones, in which the setting is substantially invisible, are known, for example as described in French Patents 802,367 and 2,570,259. In such known settings, however, the gemstones are fixed mainly at their corners, which results in a relatively weak securement of the gemstones.

OBJECTS AND BACKGROUND OF THE INVENTION

An object of the present invention is to provide a gemstone assembly having a substantially invisible setting in which the gemstone or gemstones are more securely fixed within the setting.

According to the present invention, there is provided a gemstone assembly comprising at least one gemstone and a setting therefor. The setting includes a base formed with a plurality of ribs defining at least one socket of rectangular configuration. The gemstone is also of rectangular configuration corresponding to the socket, and is formed with an upper table, a lower pavilion, a girdle between the table and pavilion, and grooves formed through at least two opposed sides of the pavilion just below the girdle. Each of the grooves extends for substantially the complete length of its respective side and is defined by a lower surface substantially parallel to the table of the gemstone and an upper surface forming an angle of 30°-60° with respect to the lower surface. The ribs of the setting are bent at their outer ends into the grooves to fix the gemstone in the socket.

In one described embodiment, the gemstone is formed with the grooves extending for substantially the complete length of all the sides of the pavilion; in another described embodiment, the grooves extend only through one pair of opposed sides of the pavilion, leaving the remaining pair of unopposed sides ungrooved.

According to further features in the described preferred embodiment, the pavilion of the gemstone is formed with lower girdle facets forming a relatively large angle to the table, the grooves being formed in the lower girdle facets. More particularly, the gemstone is formed with three groups of lower girdle facets, the first group closest to the girdle forming the largest angle with respect to the table, the second group next to the first group forming a smaller angle with respect to the table, and the third group forming a still smaller angle with respect to the table. Best results have been obtained wherein the lower surface of each of the grooves is substantially aligned with the juncture of the second and third groups of lower girdle facets, and the outer edge of the upper surface of each of the grooves is substantially aligned with the juncture of the first and second groups of lower girdle facets.

According to further features in the described preferred embodiments, the outer end of each of the ribs of the setting is formed with opposed faces converging towards their outer edges. In one described embodiment, each of the ribs is divided into at least two sections but into the grooves in the gemstone on the opposite side of the rib. Preferably, each rib is divided into three sections, the two end sections being bent into the groove of the gemstone at one side of the rib, and the intermediate section being bent into the groove of the gemstone at the opposite side of the rib.

According to a still further feature in the described preferred embodiments, the base of the setting is formed with a plurality of ribs dividing the base into a plurality of sockets each of a rectangular configuration, the assembly including a plurality of the gemstones each of a rectangular configuration corresponding to one of the sockets and fixed therein by the ribs bent into its respective grooves.

A gemstone assembly constructed in accordance with the foregoing features fixes the gemstone or gemstones in a manner which is very secure and stable and in which the setting is substantially invisible.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
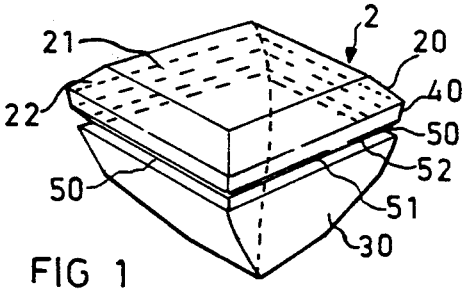
FIG. 1 illustrates one of the gemstones, particularly a diamond, constructed in accordance with the present invention for inclusion in a gemstone assembly having a relatively invisible setting.

With reference first to FIG. 1, there is illustrated a typical gemstone, particularly a diamond, after it has been processed for purposes of including it in a gemstone assembly having a plurality of such diamonds and securing all the diamonds in a setting which is substantially invisible. The diamond illustrated in FIG. 1, therein generally designated 2, is of square configuration. It includes an upper crown 20 formed with a flat table 21 and a plurality of bezel facets 22, a lower pavilion 30, and a girdle 40 intermediate the crown and pavilion and defining the largest dimension of the diamond. The diamond is further formed with a groove 50 through each of the four sides of the pavilion 30 just below the girdle 40.

Figure 1A:
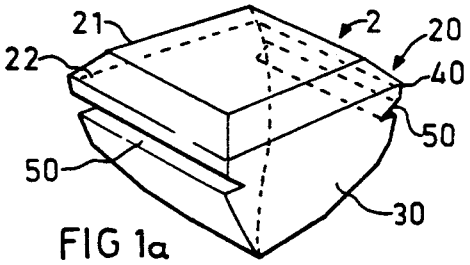
FIG. 1*a* illustrates a variation in the construction of the diamond for inclusion in the gemstone assembly.

FIG. 1*a* illustrates a variation in the diamond of FIG. 1, in that the grooves 50 are formed only in two opposite sides of the pavilion of the diamond, the remaining two sides being ungrooved. In all other respects, the diamond of FIG. 1*a* is the same as in FIG. 1.

Figure 2:
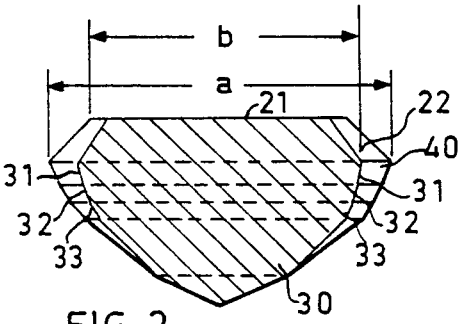
FIG. 2 is a transverse sectional view illustrating one step in processing the diamond of FIG. 1 for purposes of inclusion in the novel gemstone assembly.

FIG. 2 illustrates the manner of cutting the diamond before forming the grooves 50. In FIG. 2, the original configuration of the diamond is shown by the non-hatched section, whereas the final configuration is shown by the hatched section.

Thus, the original diamond having a girdle width of "a" is cut to a girdle width of "b" which is approximately 90% of the width "a". In the so-processed diamond (represented by the hatched section), the bevel facets 22, between the table 21 and girdle 50, form a slightly larger angle to the plane of the table than in the original diamond. In addition, the diamond is cut with three groups of lower girdle facets 31, 32 and 33, in the pavilion 30 just below the girdle 40. The group of girdle facets 31, closest to the girdle 40, form the largest angle to the plane of the table; the next group of facets 32 form a slightly smaller angle to the table, and the third group of facets 33 furthest from the girdle 50 form an even smaller angle to the table. As shown in FIG. 2, the three groups of lower girdle facets 31, 32 and 33 in the processed diamond (represented by the hatched portion of FIG. 2) form larger angles to the table 21 than the same facets before processing the diamond.

Figure 3:
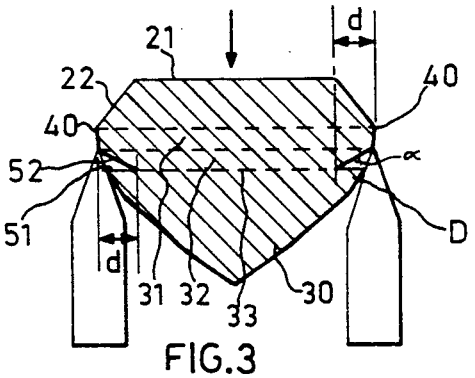
FIG. 3 is a transverse sectional view illustrating the diamond of FIG. 2 after it has been cut with grooves for inclusion in the novel gemstone assembly.

FIG. 3 more clearly illustrates the shape and location of each of the grooves 50 extending through all four sides of the pavilion (FIG. 1), or only through two opposed sides (FIG. 1*a*).

Thus, as shown in FIG. 3, each of the grooves 50 is of V-configuration, including a lower surface 51 substantially parallel to the flat table 21 of the diamond, and an upper surface 52 forming an angle ($\alpha$), preferably within the range of 30°–60°, with respect to the lower surface 51. The lower surface 51 is substantially aligned with the juncture of the second and third groups of lower girdle facets 32, 33; and the outer edge of the upper surface 52 is substantially aligned with the juncture of the first and second groups of lower girdle facets 31, 32, respectively.

As further shown in FIG. 3, each of the grooves 50 is cut to a depth of "d" such that its inner apex is substantially aligned with the outer edge of the table 21 on the respective side of the diamond. The depth of each of the grooves 50 may be somewhat less than this, but then the fixing of the diamond in its setting, as will be described more particularly below, would be somewhat less secure; if the depth of these grooves is larger than this, the setting would start to become visible when viewed through the table.

Angle $\alpha$, defined by the two surfaces 51, 52 of each of the grooves 50, is preferably between 30° and 60°. It is desirable that this angle be as large as possible in order to enable the groove to receive more metal of the setting; and thereby to better secure the diamond within its setting, but if this angle is too large, i.e., over 60°, the setting will tend to be visible when viewed through the table.

Figure 4A:
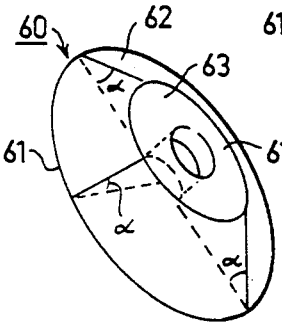
FIGS. 4*a* and 4*b* are three dimensional and side elevational views, respectively, illustrating the grooving disc for cutting the grooves shown in FIG. 3.
Figure 4B:
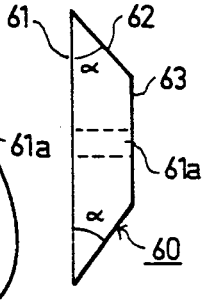

FIGS. 4*a* and 4*b* illustrate one form of grooving disc, generally designated 60, which may be used for cutting the grooves 50. Thus, as shown in these figures, the grooving disc 60 is of frusto-conical configuration, including a large-diameter flat disc 61, a frusto-conical wall 62, and a small diameter flat disc 63. The two flat discs 61, 63 are formed with openings, as shown at 61*a*, 63*a*, for mounting the disc to the disc holder.

It will be seen that when disc 60 is used to cut the grooves 50, the larger-diameter disc 61 forms the horizontal surface 51 of the groove 50, and the frusto-conical wall 62 defines the inclined surface 52 of the groove forming the angle $\alpha$ with respect to surface 51. It will be appreciated that when finally polishing all the surfaces of the diamond, the groove surfaces 51 and 52 are also polished so as not to diffuse the light.

Figure 5:
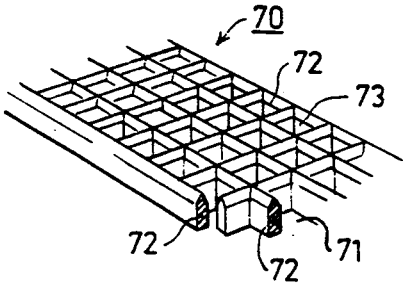
FIG. 5 is a three-dimensional view, partly in section, illustrating a setting for receiving a plurality of diamonds each as illustrated in FIG. 3.
Figure 6:
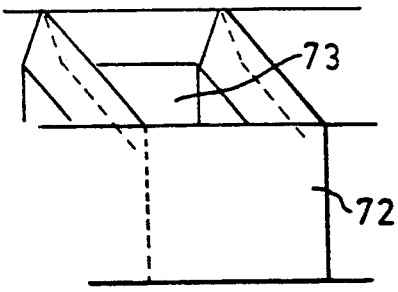
FIG. 6 is an enlarged three-dimensional view illustrating one socket of the setting of FIG. 5.

FIG. 5 illustrates one form of setting, generally designated 70, which may be used for mounting a plurality of diamonds 2 each cut with four grooves 50 as illustrated in FIG. 1, or with only two grooves as illustrated in FIG. 1*a*.

Figure 7:
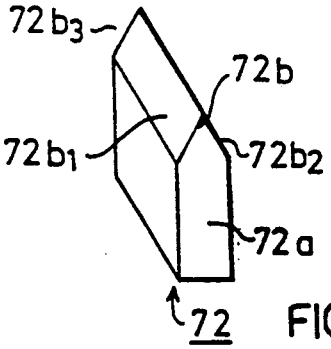
FIG. 7 is a three-dimensional view illustrating one of the ribs in the setting of FIG. 5.

As shown in FIG. 5, setting 70 includes a base 71 formed with a plurality of ribs 72 dividing the base into a plurality of sockets 73 each of a square shape, corresponding to the square shape of each of the diamonds 2 to be fixed within the setting. As shown particularly in FIG. 7, each of the ribs 72 is formed with a lower trunk 72*a* of substantially uniform thickness, and an outer end 72*b* of V-shaped configuration with its two opposed faces $72b_1$, $72b_2$ converging to form a sharp outer edge $72b_3$.

Figure 8:
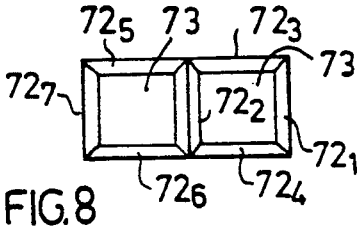
FIG. 8 is an enlarged plan view illustrating two of the sockets in the setting of FIG. 5.
Figure 9:
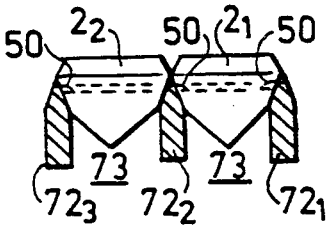
FIG. 9 illustrates the manner of securing two diamonds in the setting of FIGS. 5–8.

FIGS. 8 and 9 illustrate how a plurality of the diamonds 2 are fixed within the sockets 73 of the setting 70 illustrated in FIG. 5. In this particular type of setting, each diamond is fixed in its respective socket by bending-over only two end ribs into the grooves 50 of the respective diamond, and therefore the two-groove construction illustrated in FIG. 1*a* may be used for this setting.

Thus, as shown particularly in FIGS. 8 and 9, one diamond $2_1$ is inserted within the rectangular socket 73 defined by the four ribs $72_1$–$72_4$, with the two grooves 50 formed in the opposite sides of the diamond facing ribs $72_1$ and $72_2$, respectively. The upper tapered ends 72*b* of the two end ribs $72_1$, $72_2$ are then bent into the grooves 50 of the diamond $2_1$ to thereby fix the diamond within its socket 73, as shown in FIG. 9.

The next diamond $2_2$ (FIG. 9) is inserted into the adjacent socket 73, with its grooves 50 facing the other pair of ribs $72_5$, $72_6$ of that respective socket. The upper tapered ends of those end ribs are then bent over into the grooves 50 of that diamond, for securing the diamond within its respective socket. It will thus be seen, that in this construction, only two sides of each diamond need to be formed with the grooves 50, as illustrated in FIG. 1*a*, and only two end ribs 72 are used for securing the diamond in its respective socket 73 of the setting.

Figure 10:
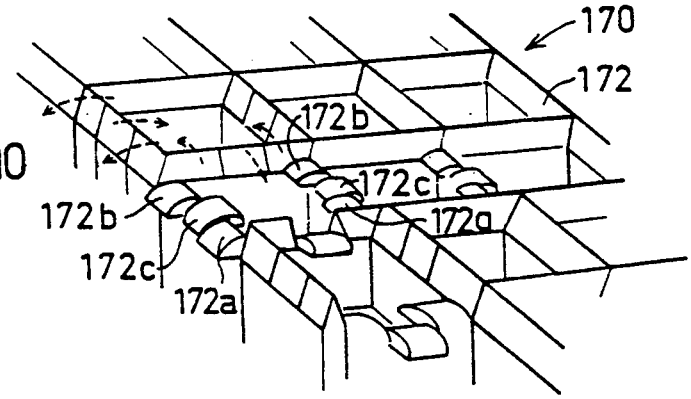
FIG. 10 is a three-dimensional view illustrating another form of setting for securing the diamonds in accordance with the present invention.

FIG. 10 illustrates another form of setting which uses all four ribs, therein designated 172, for fixing each diamond in its respective socket. When using the setting of FIG. 10, each diamond 2 would be formed with four grooves 50, as shown in FIG. 1. For this purposes, each of the ribs 172 in the setting is divided into at least two sections bent in opposite directions for reception in the grooves 50 of the diamonds on the opposite side of the respective rib.

Figure 11:
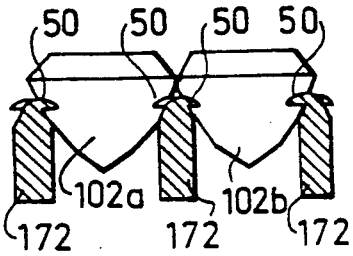
FIG. 11 illustrates the manner of securing two diamonds in the setting of FIG. 10.

More particularly, in the setting 170 illustrated in FIG. 10, each of the ribs 172 is divided into three sections 172*a*, 172*b* and 172*c*. The two end sections 172*a*, 172*b* are bent into the groove of the diamond on one side of the rib, as shown by diamond 102*a* in FIG. 11; whereas the intermediate section 172*c* is bent into the groove of the diamond (102*b*, FIG. 11) on the opposite side of the respective rib. Such a construction, wherein grooves 50 are provided on all four sides of each diamond, securely and stably fixes each diamond in its respective socket of the setting.

When using the setting illustrated in FIG. 10, it will be appreciated that all the ribs 172 of the setting would be divided into the three sections 172*a*–172*c*, except those along the outer edges of the diamond assembly. The outer ribs need not be divided into the three sections since they would be bent only inwardly into the grooves 50 of the diamonds on the inward side of the ribs.

In producing a diamond assembly of a desired configuration, the setting (70, FIG. 5 or 170, FIG. 10) is first designed according to the overall configuration of the assembly, and with its array of ribs 72 formed according to the size and number of diamonds to be included in the assembly. Each socket 73 defined by the ribs 72 is precisely measured, and the diamond to be received in the respective socket is then precisely cut according to those measurements. Each diamond is fixed into its respective socket by bending the upper end of the ribs into its respective grooves 50, as described above. Such a construction produces a diamond assembly in which the setting is covered by the diamond girdles and is substantially invisible when the assembly is viewed through the diamond tables, and in which the setting securely holds each diamond in its respective socket. The setting construction illustrated in FIG. 5 is adequate in most cases for securely fixing each diamond in its respective socket, but if a more secure fixing is desired, particularly where the assembly includes larger-sized diamonds, the setting construction illustrated in FIG. 10 may be used.

It will thus be seen that the gemstone assembly may be of any desired configuration, with the base of the setting formed according to the desired configuration and having a plurality of ribs dividing it into a plurality of sockets each of a square or other polygonal configuration. The base may thus define a two-dimensional matrix of sockets as shown in FIGS. 5 and 10, respectively, or if desired only a single socket or a linear array of such sockets.

Figure 12:
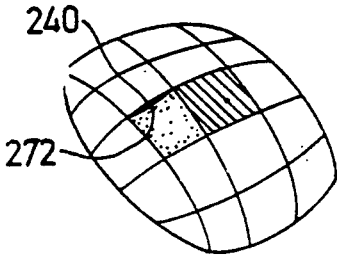
FIG. 12 illustrates the manner of securing a plurality of diamonds in a curved gem assembly in accordance with the present invention.

If the gemstone assembly desired to be produced is substantially flat, the base (71, FIG. 5) of the setting would in turn be flat. However, the gemstone assembly may also have a curved configuration, concave or convex. Such a case is illustrated in FIG. 12, wherein the base (71, FIG. 5) of each of the diamonds 2 conforms to the curved configuration. The ribs 272, however, would be straight, but the girdles 240 would also be cut to the required curvature so as to substantially abut each other when the diamonds are mounted in the setting.

While the invention has been described with respect to producing diamond assemblies wherein each diamond is of square configuration, it will be appreciated that the invention could also be used for producing assemblies of other gemstones, and with other polygonal configurations.

Other modifications, variations and applications of the invention will be apparent.

What is claimed is:

1. A gemstone assembly comprising:

at least one gemstone and a setting therefor;

said setting including a base formed with a plurality of ribs defining at least one socket of a rectangular configuration;

said gemstone being of a rectangular configuration corresponding to said socket, and formed with an upper table, a lower pavilion, a girdle between the table and pavilion, and grooves formed through at lest two opposed sides of the pavilion just below the girdle;

said ribs of the setting being bent at their outer ends into said grooves to fix the gemstone in said socket;

said gemstone being formed with three groups of lower girdle facets, the first closest to the girdle forming the largest angle with respect to the table, the second group next to the first group forming a smaller angle with respect to the table, and the third group forming a still smaller angle with respect to the table;

the lower surface of each of said grooves being substantially aligned with the juncture of said second and third groups of lower girdle facets, and the outer edge of the upper surface of each of said grooves being substantially aligned with the juncture of the first and second groups of lower girdle facets.

2. The gemstone assembly according to claim 1, wherein each of said grooves extends for substantially the complete length of its respective side and is defined by a lower surface substantially parallel to the table of the gemstone and an upper surface forming an angle of 30°–60° with respect to said lower surface.

3. The gemstone assembly according to claim 1, wherein said socket of the setting, and said gemstone fixed therein, are of substantially square configuration.

4. The gemstone assembly according to claim 1, wherein all the sides of the gemstone are formed with said grooves.

5. The gemstone assembly according to claim 1, wherein the outer end of each of said ribs of the setting is formed with opposed faces converging towards its outer edge.

6. The gemstone assembly according to claim 5, wherein each of said ribs is divided into at least two sections, one section being bent into the groove of the gemstone at one side of the respective rib, and the other section being bent into the groove of the gemstone at the opposite side of the respective rib.

7. The gemstone assembly according to claim 6, wherein each of said ribs is divided into three sections, the two end sections being bent into the groove of the gemstone at one side of the respective rib, and the intermediate section being bent into the groove of the gemstone at the opposite side of the respective rib.

8. The gemstone assembly according to claim 1, wherein said base of the setting is formed with a plurality of ribs dividing the base into a plurality of sockets each of a rectangular configuration, the assembly including a plurality of said gemstones each of a rectangular configuration corresponding to one of said sockets and fixed therein by said ribs bent into its respective grooves.

9. A gemstone assembly comprising:

a plurality of gemstones and a setting therefor;

said setting including a base formed with a plurality of ribs dividing the base into a plurality of sockets each of a rectangular configuration;

each of said gemstone being of a rectangular configuration corresponding to said sockets, and formed with an upper table, a lower pavilion, a girdle between the table and pavilion, and grooves extending through at least two opposed sides of the pavilion just below the girdle;

each of said grooves extending for substantially the complete length of its respective side and being defined by a lower surface substantially parallel to the table of the gemstone and an upper surface forming an angle of 30°–60° with respect to said lower surface;

said ribs of the setting being bent at their outer ends into said grooves of the gemstones to fix the gemstones in said sockets;

each of said gemstones being formed with three groups of lower girdle facets, the first group closest to the girdle forming the largest angle with respect to the table, the second group next to the first group forming a smaller angle with respect to the table, and the third group forming a still smaller angle with respect to the table;

the lower surface of each of said grooves being substantially aligned with the juncture of said second and third groups of lower girdle facets, and the outer edge of the upper surface of each of said grooves being substantially aligned with the juncture of the first and second groups of lower girdle facets.

10. The gemstone assembly according to claim 9, wherein each of said gemstones is formed with bezel facets between its table and girdle, each of said grooves being cut to a depth substantially equal to the outer edge of the table on the respective side of the gemstone.

* * * * *